US008627988B2

(12) United States Patent
Bergkvist

(10) Patent No.: US 8,627,988 B2
(45) Date of Patent: Jan. 14, 2014

(54) BABY CARRIER

(75) Inventor: Hakan Bergkvist, Bromma (SE)

(73) Assignee: BabyBjörn AB, Solna (SE)

( * ) Notice: Subject to any disclaimer, the term of this patent is extended or adjusted under 35 U.S.C. 154(b) by 339 days.

(21) Appl. No.: 13/033,992

(22) Filed: Feb. 24, 2011

(65) Prior Publication Data

US 2012/0187161 A1 Jul. 26, 2012

(30) Foreign Application Priority Data

Jan. 25, 2011 (SE) ..... 1150050.1

(51) Int. Cl.
*A47D 13/02* (2006.01)

(52) U.S. Cl.
USPC ..... 224/160

(58) Field of Classification Search
USPC ..... 224/158–161, 639–641; 119/770
See application file for complete search history.

(56) References Cited

U.S. PATENT DOCUMENTS 5,732,861 A * 3/1998 Jakobson ..... 224/160
2010/0102097 A1* 4/2010 Lundh ..... 224/160
2010/0108727 A1* 5/2010 Lundh ..... 224/160
2010/0237112 A1* 9/2010 Zhang ..... 224/161
2011/0186605 A1* 8/2011 Favorito et al. ..... 224/160

FOREIGN PATENT DOCUMENTS

WO WO 03/003880 A1 1/2003

* cited by examiner

*Primary Examiner* — Justin Larson
*Assistant Examiner* — Corey Skurdal
(74) *Attorney, Agent, or Firm* — Jacobson Holman PLLC

(57) ABSTRACT

A baby carrier includes two strap loops, which are interconnected and arranged to extend around the two shoulder areas of the wearer, a relief belt that extends around the waist, and a carrying pocket mounted to the strap loops and the relief belt, with a front piece that is attached to an adjacent strap loop via an upper connection device, and a seat part that is attached to the relief belt via a lower connection device. The front piece and the relief belt, below the upper connection device, define a leg opening. The lower connection device includes an intermediate piece to which the seat part is attached, and a fastening member arranged at each side and detachably attached to the intermediate piece, and the respective part of the relief belt is attached to the respective fastening member for vertically turnable attachment of the relief belt to the lower connection device.

8 Claims, 4 Drawing Sheets

BABY CARRIER

FIELD OF THE INVENTION

The invention relates to a baby carrier that in general includes two shoulder strap loops, a relief belt that extends around the waist of the wearer, a carrying pocket, and a seat part.

BACKGROUND OF THE INVENTION

Thus, the baby carrier is of the type that comprises two strap loops, which are interconnected and arranged to extend around the two shoulder areas of the wearer, a relief belt that extends around the waist of the wearer, which relief belt is connected with the respective strap loop on at least the chest side of the wearer, and a carrying pocket that is mounted to the strap loops and the relief belt and has a front piece having at least one free side edge that can be attached to an adjacent strap loop by means of an upper connection device for the carrying of the front piece at the strap loop, and an essentially band-shaped seat part that can be attached to the relief belt by means of a second connection device, the front piece and the relief belt below the upper connection device defining a leg opening for a child sitting in the baby carrier.

On account of the fact that a child increases its own weight approx. 3 times and becomes approx. 30% longer during its first year of life, it is common to provide a baby carrier with a relief belt that extends around the waist of the wearer. This is for allowing the carrying of a heavier child in a convenient way, and more precisely for relieving the pressure on the shoulders of the wearer to as great an extent as possible.

Till now, the baby carriers available on the market and provided with relief belts have been formed in such a way that the lower part of the carrying pocket/bag carried by the carrier is attached, either adjustably or fixedly, to the upper edge of the relief belt.

When the baby carrier is loaded, this results in that the upper edge of the relief belt tends to rotate, i.e., turn downward and outward from the wearer, wherein particularly the lower edge of the relief belt will press against the stomach of the wearer. This feeling of discomfort is enhanced when the child becomes heavier, and particularly if some form of stiff connection device is arranged for the attachment of the lower part of the carrying pocket/bag to the relief belt.

In order to avoid the occurrence of any stiff connection device or any other stiff member of the relief belt on the front side of the wearer, the relief belt is usually formed in such a way that the assembly of the two parts of the relief belt by means of, usually, a buckle for the formation of a closed loop, as well as the regulation of the diameter of the closed loop according to the size of the wearer, is made on his or her back side. This is a disadvantage since it can be hard to reach the buckle in order to lock the buckle as well as to open the same.

Further, there is always a factor of uncertainty associated with an openable buckle that is placed on the back side of the wearer in that it mistakenly may open when the wearer of the carrier bends, e.g., forward. If this happens, it is very likely that the wearer falls forward over the child because of the entire weight then being put on the shoulders of the wearer, particularly since this type of baby carrier is intended for the carrying of a heavier child, up to, e.g., 12 kg.

Thus, it would be desirable to provide a baby carrier with a buckle for opening and closing the relief belt that is placed on the chest side/front side of the wearer and that does not cause the above-mentioned feeling of discomfort. In a baby carrier of the type mentioned above, this also allows the baby carrier to be put on and taken off in the form of a jacket.

SUMMARY OF THE INVENTION

Thus, the object of the invention is to provide a baby carrier by which the above-mentioned disadvantages are at least partly eliminated.

This object is achieved by a baby carrier that includes two strap loops, which are interconnected and arranged to extend around the two shoulder areas of the wearer, a relief belt that extends around the waist of the wearer, which relief belt is connected with the respective strap loop on at least the chest side of the wearer, and a carrying pocket that is mounted to the strap loops and the relief belt and has a front piece having at least one free side edge that can be attached to an adjacent strap loop by means of an upper connection device for the carrying of the front piece at the strap loop, and a seat part that can be attached to the relief belt by means of a lower connection device, the front piece and the relief belt below the upper connection device defining a leg opening for a child sitting in the baby carrier, wherein the lower connection device comprises an intermediate piece to which the sit part can be attached, as well as a fastening member arranged at each side and at least one of which detachably attached to the intermediate piece, and wherein the respective part of the relief belt can be attached to the respective fastening member for the provision of vertically turnable attachment of the relief belt to the lower connection device.

Preferred embodiments of the baby carrier are as described herein.

BRIEF DESCRIPTION OF THE DRAWINGS

The invention is described in more detail below in the form of non-limiting examples, reference being made to the appended drawings, in which.

DESCRIPTION OF PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

In the description and claims below, the expressions vertically and horizontally directed as well as upper and lower are utilized, and it should be understood that these expressions relate to when the baby carrier is worn by a wearer.

Figure 1:
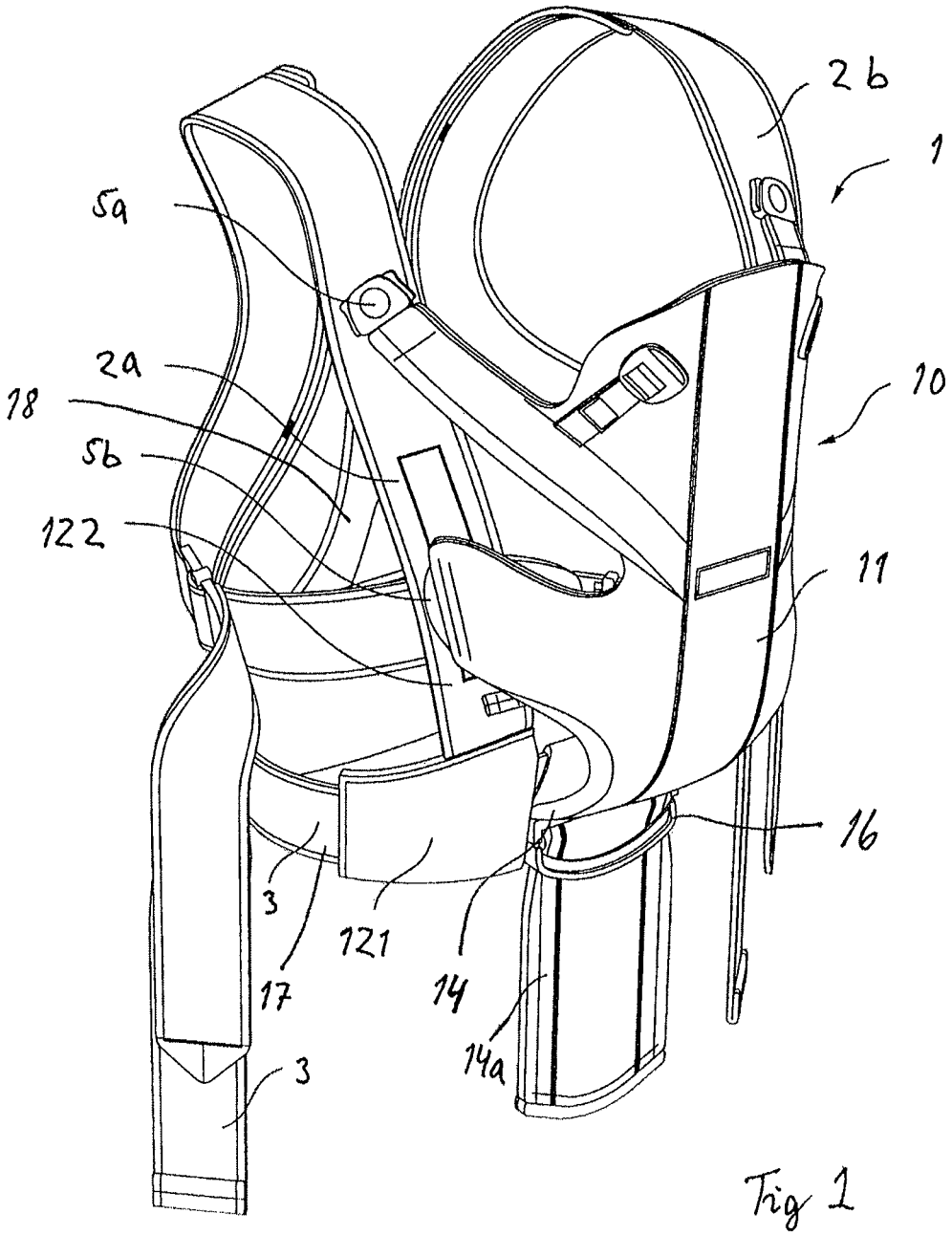
FIG. 1 is an overall view obliquely from the front of a baby carrier according to the invention.

As is seen in FIG. 1, a baby carrier 1 according to the invention comprises two strap loops 2*a*, 2*b*, which are interconnected and arranged to extend around the two shoulder areas of the wearer, a relief belt 3 that extends around the waist of the wearer, which relief belt is connected with the respective strap loop on at least the chest side of the wearer, and a carrying pocket 10 that is mounted to the strap loops and the relief belt and has a front piece 11 having at least one free side edge that can be attached to an adjacent strap loop 2*a*, 2*b* by means of an upper connection device 5*a*, 5*b* for the carrying of the front piece 11 at the strap loop. The front piece 11 is provided with a seat part 14 that essentially may be band-shaped and that can be attached to the relief belt 3 by means of a lower connection device 16. Further, at least one part 17 of the relief belt should be detachably connected with the lower connection device. The front piece 11 defines, together with the relief belt 3 below the upper connection device 5*b*, a leg opening for a child sitting in the baby carrier.

At least the front piece 11 and the seat part 14 are preferably manufactured from a flexible padded fabric material.

The attachment of the front piece 11 to the upper connection device 5*a*, 5*b* is made in a known way, and preferably in the same way as described in, e.g., WO 03/003880, and therefore it will not be described in more detail.

Figure 2:
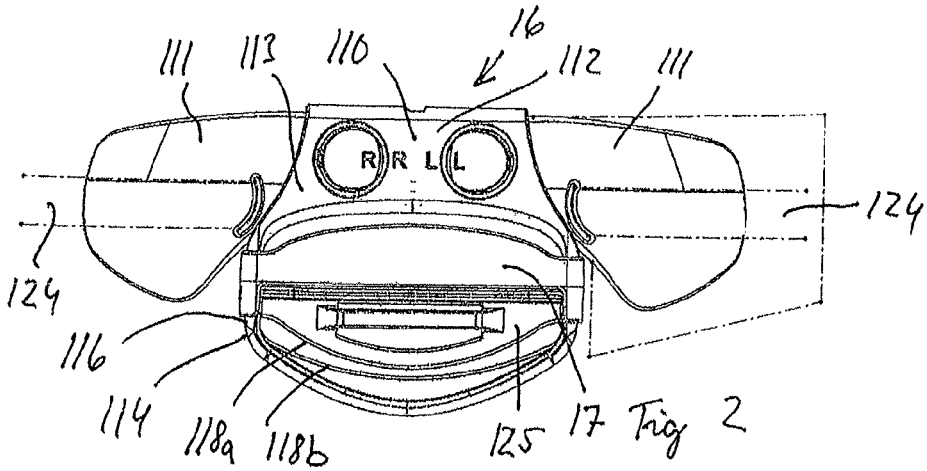
FIG. 2 is a view from the front of a lower connection device shown schematically connected via fastening ears to a relief belt (not shown) by means of straight bands and having a schematically shown clothing of one of the fastening ears.
Figure 3:
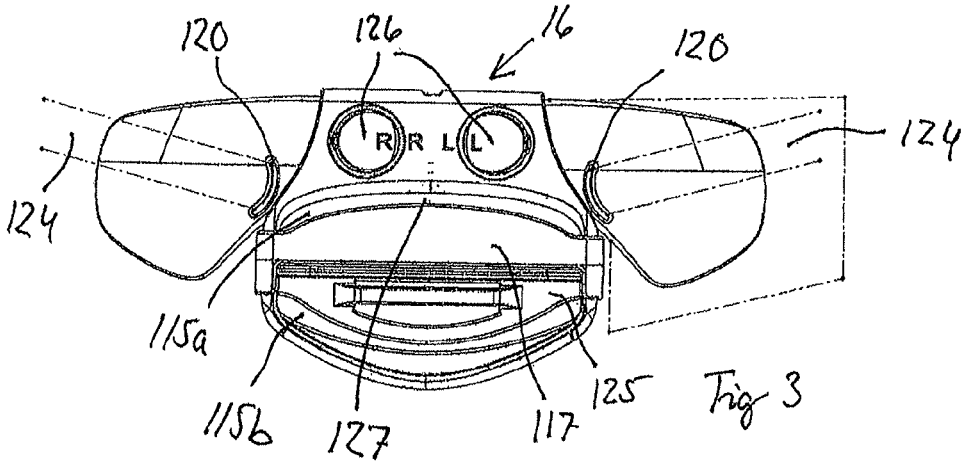
FIG. 3 is a view from the front of a lower connection device shown schematically connected via fastening ears to a relief belt (not shown) by means of oblique bands and having a schematically shown clothing of one of the fastening ears.

In FIGS. 2 and 3, there are seen that the lower connection device 16 comprises an intermediate piece 110 to which the seat part 14 can be attached. At the area of the attachment thereof to the intermediate piece, the seat part 14 is essentially band-shaped. The lower connection device 16 is also provided with a fastening member 111 arranged at each side, preferably in the form of a fastening ear 111, to which the respective part/end 17 of the relief belt 3 can be attached in such a way that it can turn in the vertical direction. This can be provided in at least two ways, viz. either by the fastening ears 111 being vertically rotationally fixedly attached to the intermediate piece 110, the respective part 17 of the relief belt 3 being vertically articulately attached to the respective fastening ear, or by the fastening ears 111 being vertically articulately attached to the intermediate piece 110, and the respective part 17 of the relief belt 3 being vertically rotationally fixedly attached to the respective fastening ear 111. In the embodiment shown in FIGS. 2 and 3, the turning occurs vertically of the parts of the relief belt in the first-mentioned way.

Further, an attachment point 126 in the baby carrier according to the invention of the respective fastening ear 111 at the intermediate piece 110 should be placed vertically above an attachment point 127 of the seat part 14 at the intermediate piece.

Further, the respective part 17 of the relief belt 3 is attached to the respective fastening ear 111 so that the attachment point thereof at the fastening ear becomes situated underneath, as seen in the vertical direction, the attachment point of the respective fastening ear 111 at the intermediate piece 110.

In a preferred embodiment of the lower fastening device shown in FIGS. 2-6, the intermediate piece 110 comprises a frame 112 having an upper anchorage part 113 for the respective fastening ear 111 and a lower anchorage part 114 for the seat part 14. Both fastening ears 111 are detachably attached to the intermediate piece, but according to the invention, it is enough if only one fastening ear is detachably attached.

Figure 4:
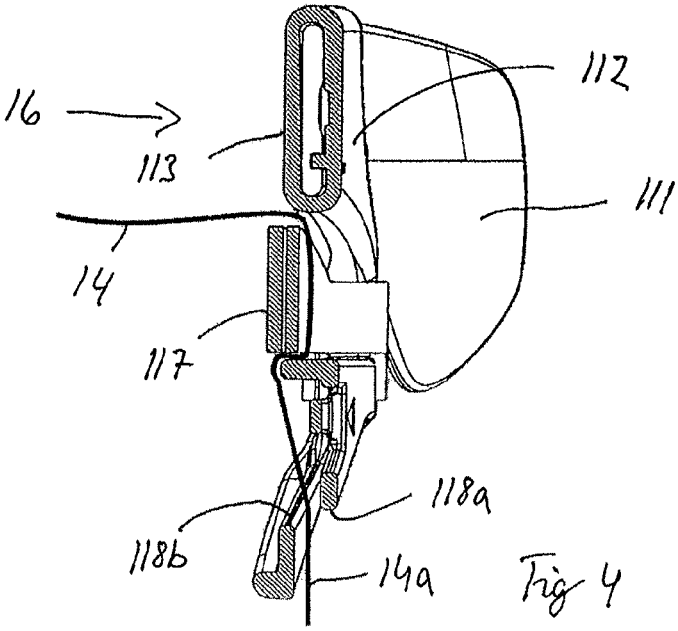
FIG. 4 is a sectioned side view of the lower connection device with a schematically shown threaded seat part of the front piece.

The lower anchorage part 114 has two openings, an upper one and a lower one 115*a*, 115*b* separated by a horizontal bar 125, the side edges 116 of the lower anchorage part being formed as guide rails for a displaceably arranged carriage 117. The upper and lower edge 118*a*, 118*b* of the lower opening 115*b* are preferably arc-shaped with the arch directed downward. Further, the edges 118*a*, 118*b* are somewhat displaced in the horizontal direction for the accommodation of the seat part 14 placed between the edges, as shown in FIG. 4.

The respective fastening ear 111 is preferably provided with an essentially vertically extending arc-shaped opening 120, through which opening a strap 124, schematically shown by horizontal dashed lines in FIG. 2 and by dashed lines angled to the horizontal line in FIG. 3, is threaded and attached to the respective part of the relief belt. In FIG. 2, the strap is shown in an unloaded state and in FIG. 3 in a loaded state of the baby carrier.

The arc-shaped openings 120 are preferably placed, as seen in the vertical direction, between the attachment point 126 of the fastening ears at the upper anchorage part 113 and the attachment point 127 of the seat part 14 at the lower anchorage part 114, and, particularly preferred, the openings 120 are placed on the same level as the attachment point 127, i.e., on the same level as the seat part 14. By this placement of the openings 120 as well as the strap 124 preferably being attached to the middle of the relief belt 3, it is made possible to lift up the child higher on the relief belt compared with conventional baby carriers.

Above, it has been described that the strap 124 is attached to the respective fastening ear 111 via an arc-shaped opening 120, but it is obvious to a person skilled in the art that the strap 124 can be articulately attached to the respective fastening ear in any other suitable way.

Figure 5:
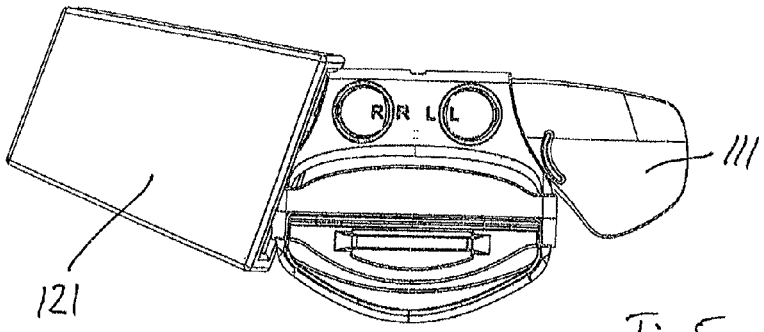
FIG. 5 is a view from the front of the lower connection device, one of the fastening ears being covered with a clothing.

In FIG. 5, one of the fastening ears 111 is shown covered with a surrounding padded clothing 121 to prevent the fastening ears from chafing against the body of the user. Preferably, the respective strap loop 2*a*, 2*b* is attached to the upper edge of the respective clothing 121 via an extension 122, see FIG. 1, of the chest part of the strap loop. This extension 122 extends between the clothing and the lower part of the upper connection device 5*b*.

Figure 6:
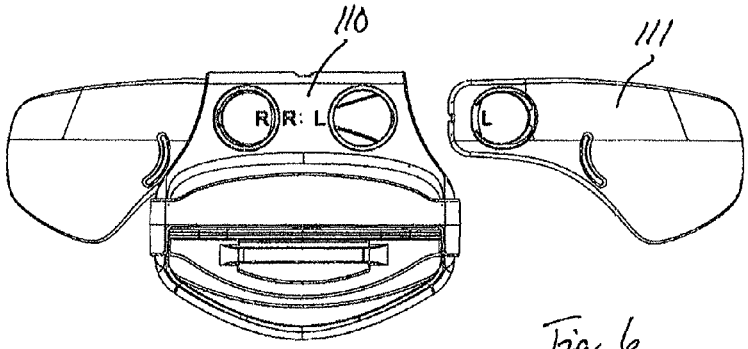
FIG. 6 is a view from the front of the lower connection device, one of the fastening ears being detached from the connection device.

FIG. 6 shows one of the fastening ears 111 detached from the intermediate piece 110.

The seat part 14 is preferably adjustably attached to the lower anchorage part 114 of the frame 112 in such a way that it is threaded through the upper opening 115*a* toward the wearer between the upper edge thereof and an upper edge of the carriage, behind the carriage, after which it is threaded from the wearer between a lower edge of the carriage and a lower edge of the upper opening, in front of the bar 125, in order to then be threaded again through the lower opening toward the wearer. This is shown in FIG. 4.

By forming the lower anchorage part and threading the seat part 14 in the above-mentioned way, an outer part 14*a* of the seat part 14 will always be lying against the stomach of the wearer, when a carrier is carried by the same, and then act as a soft "cushion" against the stomach. This entails that a possibly discomfort in the form of the lower connection device 16, particularly the lower anchorage part, pressing against the stomach of the wearer can be minimized.

Figure 7:
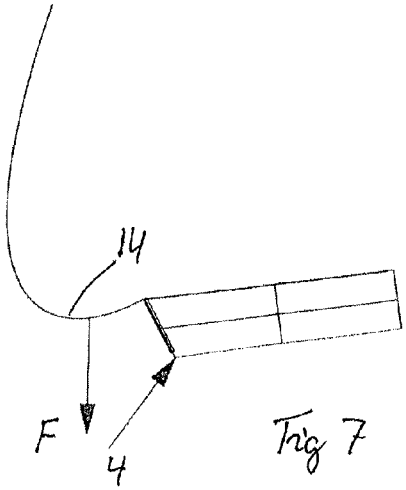
FIG. 7 is a schematic view illustrating the arisen load on a conventional relief belt having the seat part of the front piece attached to the upper edge of the relief belt.
Figure 8:
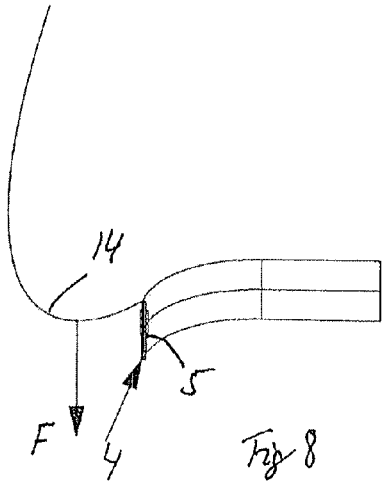
FIG. 8 is a view similar to the one in FIG. 7 of a relief belt having the seat part of the front piece attached to the upper edge of the relief belt and having articulatable fastening of the two parts of the relief belt at a connection device placed at the stomach of the wearer.

When a child is placed in the baby carrier, the seat part 14 will be loaded by a force F as schematically shown in FIGS. 7 and 8, FIG. 7 showing the loading case in a known baby carrier, and FIG. 8 showing the loading case in the baby carrier according to the invention. As is seen in FIG. 7, the lower edge 4 of the relief belt turns inward against the wearer, which entails discomfort. In FIG. 8, it is seen that, in the baby carrier according to the invention, the relief belt maintains a vertical, i.e., plane contact surface 5 against the wearer. The possible pressure against the wearer that may arise by the fact that the lower connection device 16 presses against the wearer is further minimized since the outer part 14*a* of the seat part is placed between the body of the wearer and the lower connection device, as has been described above. However, it should be mentioned that in the last-mentioned case, the seat part is shown attached to the upper edge of the relief belt.

By the above-mentioned design of the lower connection device 16 in combination with the design of the baby carrier, it is achieved that the relief belt 3 gets an almost vertical, plane, contact surface against the front side of the wearer also when the baby carrier is loaded. By giving the fastening ears and the intermediate piece a suitable shape rounded in the horizontal direction, a relatively large contact surface against the front side of the wearer is in addition provided.

Figure 1A:
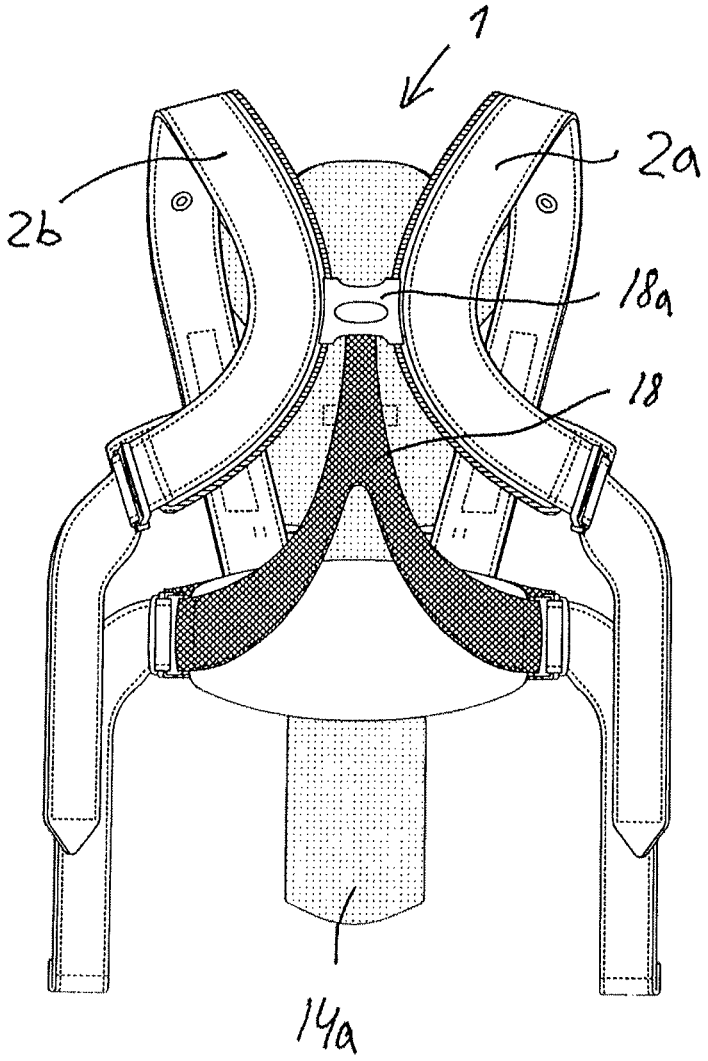
FIG. 1*a* is a view from the back of the baby carrier in FIG. 1.

As seen in FIG. 1*a* the relief belt 3 is in addition vertically adjustably connected with the strap loops 2*a*, 2*b* on the back side of the wearer via a stiff member 18 which also adjustably interconnects the strap loops 2*a*, 2*b* via an adjustment means 18*a*. The adjustment means 18*a* is slidably attacked to respective edge of the strap loops facing each other.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A baby carrier comprising two strap loops, which are interconnected and arranged to extend around the two shoulder areas of a wearer, a relief belt that extends around the waist of the wearer, which relief belt is connected with the respective strap loop on at least the chest side of the wearer, and a carrying pocket that is mounted to the strap loops and the relief belt and has a front piece having at least one free side edge that can be attached to an adjacent strap loop via an upper connection device for carrying the front piece at the strap loop, and a seat part that can be attached to the relief belt via a lower connection device, the front piece and the relief belt below the upper connection device defining a leg opening for a child sitting in the baby carrier, the lower connection device including an intermediate piece to which the seat part is attached, and a fastening member arranged at each side with at least one of which detachably attached to the intermediate piece, the respective fastening member being arranged to protrude from the intermediate piece diametrically opposing each other, and at least one of i) the fastening members being vertically rotationally fixedly attached to the intermediate piece, and the respective part of the relief belt being vertically articulately attached to the respective fastening member, and ii) the fastening members being vertically articulately attached to the intermediate piece, and the respective part of the relief belt being vertically rotationally fixedly attached to the respective fastening member.

2. The baby carrier according to claim 1, wherein an attachment point of the respective fastening member at the intermediate piece is placed vertically above an attachment point of the seat part.

3. The baby carrier according to claim 1, wherein the intermediate piece includes a frame having an upper anchorage part for the respective fastening member and a lower anchorage part for the seat part, the lower anchorage part having an upper opening, side edges of which are formed as guide rails for a displaceably arranged carriage, and an upper edge of which constitutes a part of the upper anchorage part and a lower edge of which cooperates with the upper edge and the carriage so that the seat part can be attached adjustably to the lower anchorage part such that an outer end of the seat part is placed between the body of a wearer of the carrier and the lower edge of the lower anchorage part.

4. The baby carrier according to claim 1, wherein the respective part of the relief belt is attached to the respective fastening member so that the attachment thereof to the fastening member is situated underneath, with respect to the vertical direction, the attachment of the respective fastening member to the intermediate piece.

5. The baby carrier according to claim 1, wherein the relief belt is vertically adjustably attached to the strap loops on the back side of the wearer via a stiff member.

6. The baby carrier according to claim 1, wherein the respective fastening member is articulately attached to the respective part of the relief belt.

7. The baby carrier according to claim 1, wherein the respective fastening member is provided with at least one arc-shaped opening through which a strap is threaded for the attachment to the respective part of the relief belt.

8. The baby carrier according to claim 1, wherein the fastening members are covered with a surrounding padded clothing to prevent the fastening members from chafing against the body of the user, and the respective strap loop is attached to an upper edge of the respective clothing via an extension of a chest part of the respective strap loop.

* * * * *